US007322554B2

(12) United States Patent
Caroselli et al.

(10) Patent No.: US 7,322,554 B2
(45) Date of Patent: Jan. 29, 2008

(54) PURSE AND ACCESSORY HOLDER

(75) Inventors: Carol Caroselli, Pittsburgh, PA (US); May Wang, Pittsburgh, PA (US)

(73) Assignee: C & W Design, LLC, Pittsburgh, PA (US)

( * ) Notice: Subject to any disclaimer, the term of this patent is extended or adjusted under 35 U.S.C. 154(b) by 314 days.

(21) Appl. No.: 10/934,325

(22) Filed: Sep. 3, 2004

(65) Prior Publication Data

US 2005/0082319 A1 Apr. 21, 2005

Related U.S. Application Data

(63) Continuation-in-part of application No. 10/074,673, filed on Feb. 13, 2002, now abandoned.

(51) Int. Cl.
*A47G 25/06* (2006.01)

(52) U.S. Cl. ..... 248/304; 248/691; 248/692; 248/914; 223/120; D3/328

(58) Field of Classification Search ..... 248/304, 248/682, 687, 690, 691, 692, 309.1, 315, 248/914, 215, 214; D3/328; 223/120
See application file for complete search history.

(56) References Cited

U.S. PATENT DOCUMENTS 2,064,133 A * 12/1936 Von Schroeder ..... 248/214
2,473,086 A * 6/1949 Montero ..... 248/308
2,532,255 A * 11/1950 Davis ..... 248/215
2,692,108 A * 10/1954 Neivert ..... 248/215
D229,870 S * 1/1974 Czaray ..... D3/328
D256,738 S * 9/1980 Dockery ..... D3/328
4,220,016 A * 9/1980 Frenger ..... 63/14.9
4,312,455 A * 1/1982 Weber ..... 211/119.005
4,978,093 A * 12/1990 Kennedy ..... 248/205.1
5,094,417 A * 3/1992 Creed ..... 248/215
5,594,419 A * 1/1997 Lo ..... 340/568.1
D384,505 S * 10/1997 Stewart ..... D3/328
D429,899 S * 8/2000 Schwartz ..... D6/327
D435,733 S * 1/2001 Osterholt ..... D3/328
D465,653 S * 11/2002 Fuschillo ..... D3/328
6,530,548 B2 * 3/2003 Pizzirusso ..... 248/304
D517,732 S * 3/2006 Osterholt et al. ..... D28/77
2003/0038220 A1 * 2/2003 Catan ..... 248/304
2004/0195484 A1 * 10/2004 Sheeran ..... 248/304
2005/0161570 A1 * 7/2005 Bauerly ..... 248/317

* cited by examiner

*Primary Examiner*—Anita M. King

(57) ABSTRACT

A holder for a clothing article, such as a purse, scarf, or glove, the holder generally including a base and a hanger, wherein the hanger supports the clothing article but does not compress the clothing article.

12 Claims, 5 Drawing Sheets

PURSE AND ACCESSORY HOLDER

BACKGROUND OF THE INVENTION

1. Field of the Invention

The present invention generally relates to holders for clothing articles, and more particularly, to holders for handbags and other accessories.

2. Description of Related Art

Devices for temporarily holding clothing articles, such as handbags, hats, and coats, are generally described in U.S. Pat. Nos. 1,415,126; 1,501,807; 2,064,133; 2,473,086; 2,521,037; 2,532,255; 4,210,302; and 5,094,417 and U.S. Design Pat. Nos. 159,834 and 256,738. For example, U.S. Pat. No. 1,415,126 to Stahle discloses a clip for holding a hat. U.S. Pat. No. 1,501,807 to Petschel discloses another type of hat supporting hook. U.S. Pat. No. 2,521,037 to Brinton discloses a C-shaped hook for holding a purse and an elastomeric strap for holding gloves. U.S. Pat. No. 5,094,417 to Creed discloses a C-shaped mount with a C-shaped hook pivotally attached thereto. U.S. Design Pat. No. 159,834 to Meyers discloses another type of holder for gloves and a handbag.

In general, the prior art reasonably teaches that as the number of clothing articles to be held increases, the complexity of the device also increases. Therefore, a need exists for a clothing article holder that accomplishes multiple functions with a reduced amount of parts.

SUMMARY OF THE INVENTION

According to the present invention, a holder for a clothing article, such as a handbag, generally includes a base having a first surface and a second surface, and a hanger having a first portion and a second portion, wherein the first portion has a first end and a second end and the second portion defines a loop. The first end of the first portion of the hanger is connected to the base, and the loop supports the clothing article but does not compress the clothing article.

A pivot joint rigidly connected to an outer edge of the base or to the body of the base may also be provided, wherein the first end of the first pendent portion of the hanger is rotatably connected to the pivot joint. A resilient pad positioned adjacent to the base, and the first surface of the base and the second surface of the base may each define a circular shape.

The loop may be a substantially closed O-shaped loop or a substantially C-shaped loop. A ball may be positioned at a free end of the C-shaped loop. The loop is designed to receive a clothing article, such as a scarf, a glove, or handbag strap.

A method of holding a clothing article, such as a handbag, is also provided. The method generally includes the steps of: a) providing a planar surface having a leading (overhanging) edge; b) providing a holder comprising a base and a hanger pivotally connected to the base, the hanger having a first pendent portion and a second portion, the second portion defining a loop; c) positioning the base of the holder on the planar surface adjacent to the leading edge of the planar surface, such that the second portion of the hanger is positioned substantially parallel to the leading edge of the planar surface, the loop extends away from the base, and the planar surface is positioned between the base and the loop; and d) inserting the clothing article or handbag strap in the loop, such that the loop supports the clothing article but does not compress the clothing article. If a stem is positioned between the loop and the first portion of the hanger, and a purse having a carrying strap is provided, a further step may include positioning the carrying strap of the purse adjacent to the stem.

This simple design of the present invention eliminates the need for multiple parts, such as constrictive elastic bands. Moreover, the loop design does not squeeze a clothing article, such as a delicate scarf, so wrinkling and other damage to the clothing article are significantly reduced.

These and other advantages of the present invention will be clarified in the description of the preferred embodiments taken together with the attached drawings in which like reference numerals represent like elements throughout.

DESCRIPTION OF THE PREFERRED EMBODIMENTS

Figure 3:
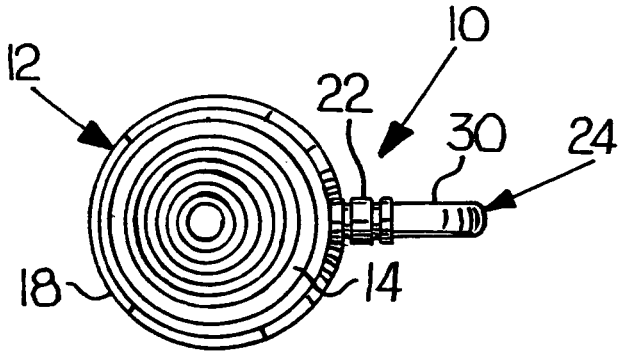
FIG. 3 is a top view of the holder shown in FIGS. 1 and 2.
Figure 2:
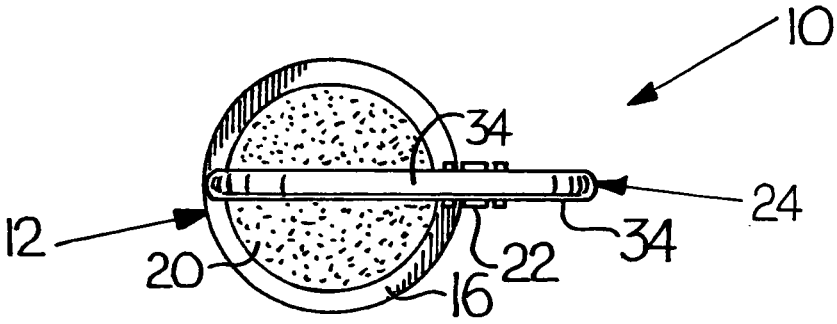
FIG. 2 is a bottom view of the holder shown in FIG. 1.
Figure 1:
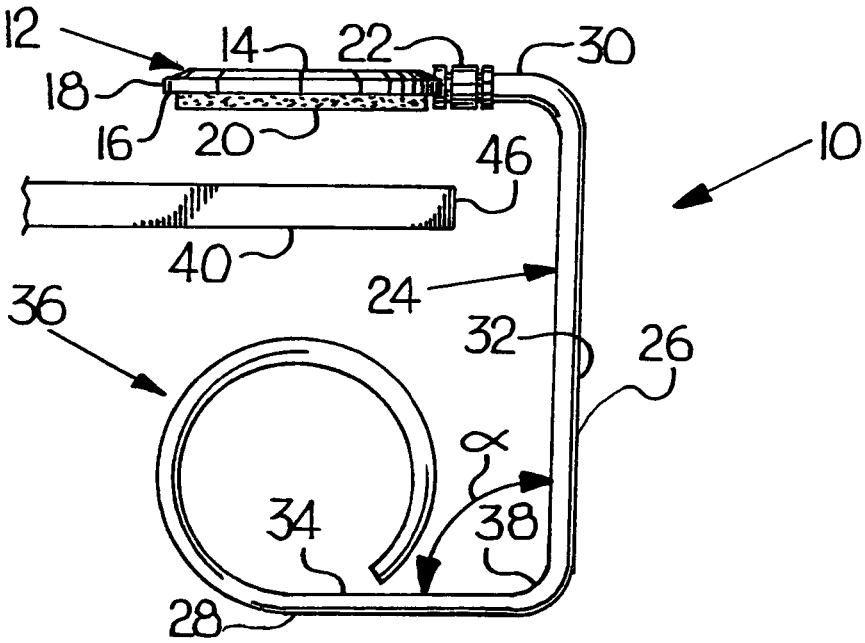
FIG. 1 is a side view of a holder according to a first embodiment of the present invention with a hanger in a deployed position.

As shown generally in FIGS. 1-6, a first embodiment of the present invention generally relates to a holder 10 for clothing articles, such as handbags, scarves, baseball caps, or other suitable articles. As shown in FIG. 1 and the combination of FIGS. 2 and 3, the holder 10 according to the present invention includes a base 12 having a first surface 14, a second surface 16, and an outer edge 18. The base 12 is preferably circular in shape when viewed from a top perspective or a bottom perspective and is made from metal, such as brass of other suitable metal of metal alloy, plastic, of any other suitable material. As shown in FIGS. 1 and 2, a protective pad 20 may be positioned adjacent the second surface 16 of the base 12. Referring again to FIGS. 1-3, in the preferred embodiment, a hollow cylinder 22 is rigidly connected to the base 12, preferably at the outer edge 18 of the base 12. The hollow cylinder 22 is also preferably made from metal, metal alloy, plastic, or other suitable material.

As shown in FIGS. 1-5, a hanger 24 is pivotally connected to the base 12 via the hollow cylinder 22. The hanger 24 may be made of metal, metal alloy, plastic, or other suitable material and generally includes a first pendent portion 26 and an integrally formed second portion 28. The first pendent portion 26 has a first end 30 and a second end 32, with the first end 30 of the hanger bent at as approximate ninety degree angle with respect to the first pendent portion 26 of the hanger 24. The first end 30 of the first pendent portion 26 of the hanger 24 is inserted into the hollow cylinder 22 as to define a pivot joint 22, so that the hanger 24 is rotatable with respect to the base 12.

The second portion 28 of the hanger 24 generally includes a stem 34 that is connected to the second end 32 of the first pendent portion 26 of the hanger 24, and a substantially closed O-shaped loop 36 is connected to the stem 34. The stem 34 intersects the second end 32 of the first pendent portion 26 of the hanger 24 at an intersection point 38 such that an angle αis defined between the first pendent portion 26 of the hanger 24 and the stem 34. The substantially closed O-shaped loop 36 is preferably large enough to allow a scarf 44, gloves, or other clothing article to easily pass through the substantially closed O-shaped loop 36 without being bunched or clamped.

Figure 4:
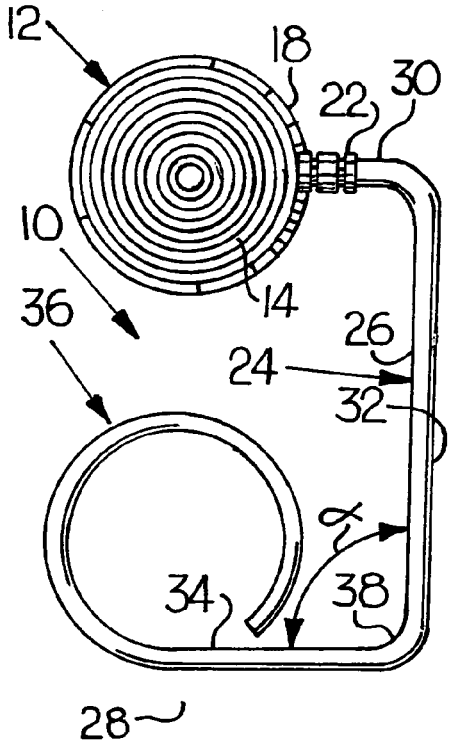
FIG. 4 is a top view of the holder shown in FIGS. 1-3 with the hanger in a storage position.
Figure 5:
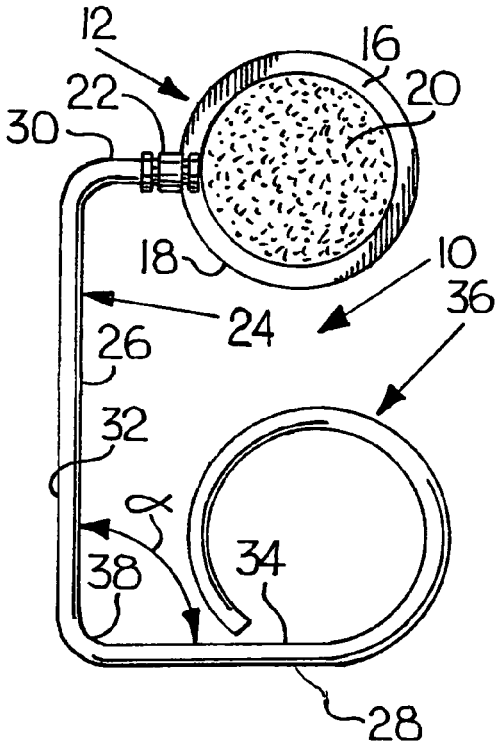
FIG. 5 is a bottom view of the holder shown in FIGS. 1-4.
Figure 6:
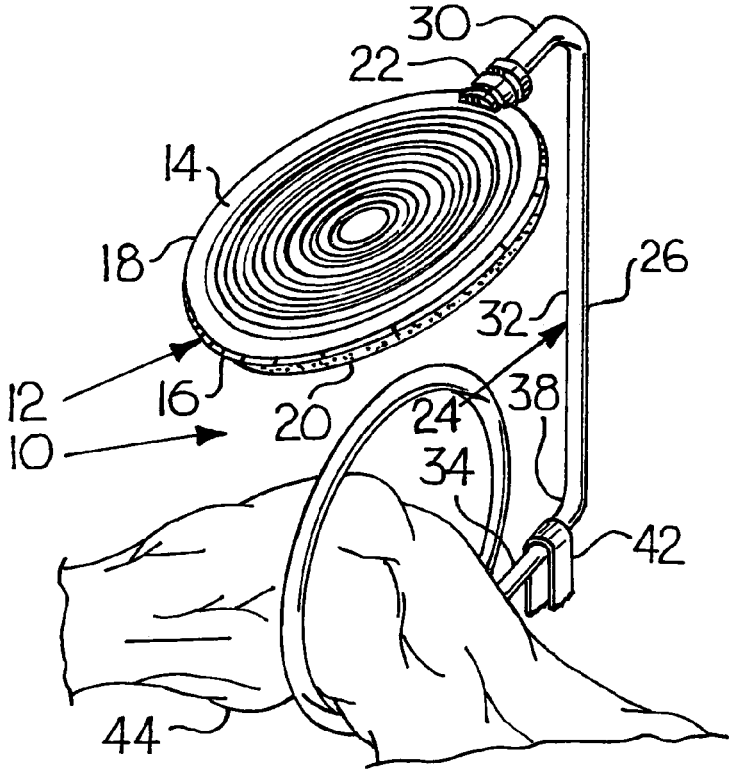
FIG. 6 is a perspective view of the holder shown in FIGS. 1-5.

FIGS. 4 and 5 show a holder 10 according to a first embodiment of the present invention in two respective storage positions. In operation, as shown in FIG. 1, the second surface 16 of the base 12 is placed on a table or other generally planar surface 40 adjacent to a leading (overhung) edge 46. The hanger 24 is pivoted with respect to the base 12 via the pivot joint 22 so that the hanger 24 extends away from the base 12 and the planar surface 40 and is substantially parallel to the leading (overhung) edge 46. As shown in FIG. 6, a handbag carrying strap 42 may be placed on the stem 34 of the second portion 28 of the hanger 24, adjacent to the intersection point 38 of the first pendent portion 26 of the hanger 24 and the stem 34. A scarf 44 or other clothing article can also be fed through the substantially closed O-shaped loop 36.

When the articles do not need to be held any longer, the scarf 44 can be removed from the substantially closed O-shaped loop 36 and the handbag carrying strap 42 can be removed from the stem 34. As shown in FIGS. 4 and 5, the base 12 can then be removed from the planar surface 40, and the hanger 24 can be moved into a storage position by pivoting the hanger 24 to lie in the same imaginary plane as the base 12.

Figure 9:
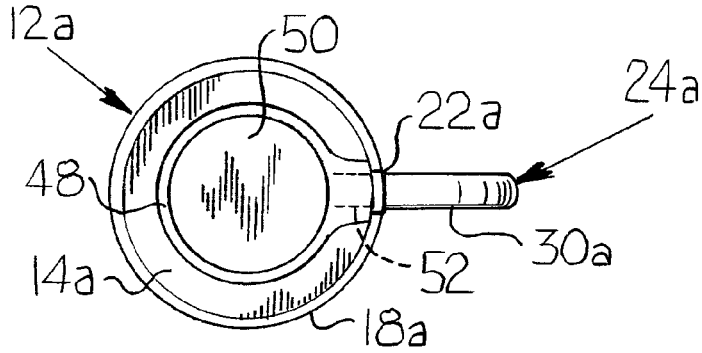
FIGS. 9 and 13 are top views of the holder shown in FIGS. 7 and 8.
Figure 7:
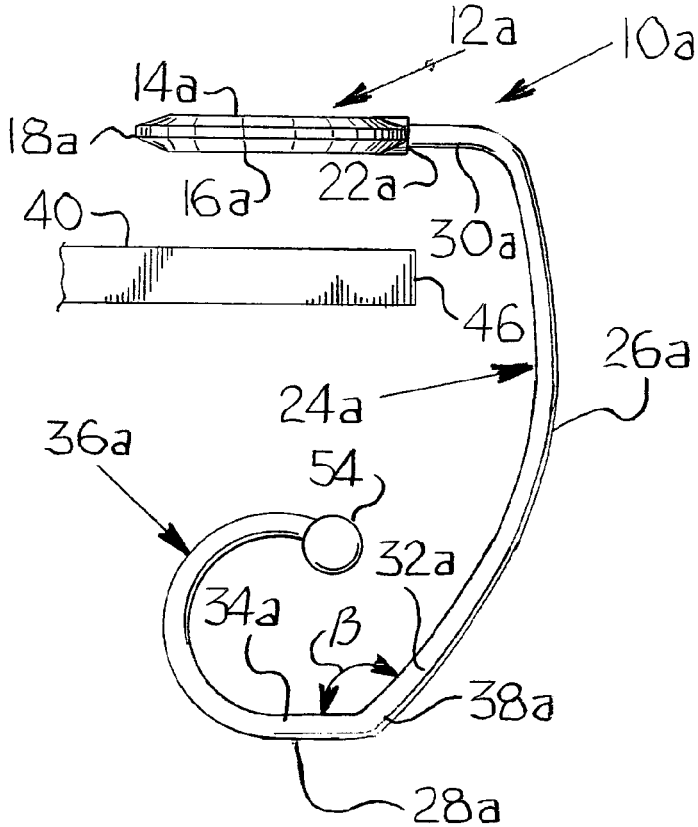
FIG. 7 is a side view of a holder according to a second embodiment of the present invention with a hanger in a deployed position.
Figure 10:
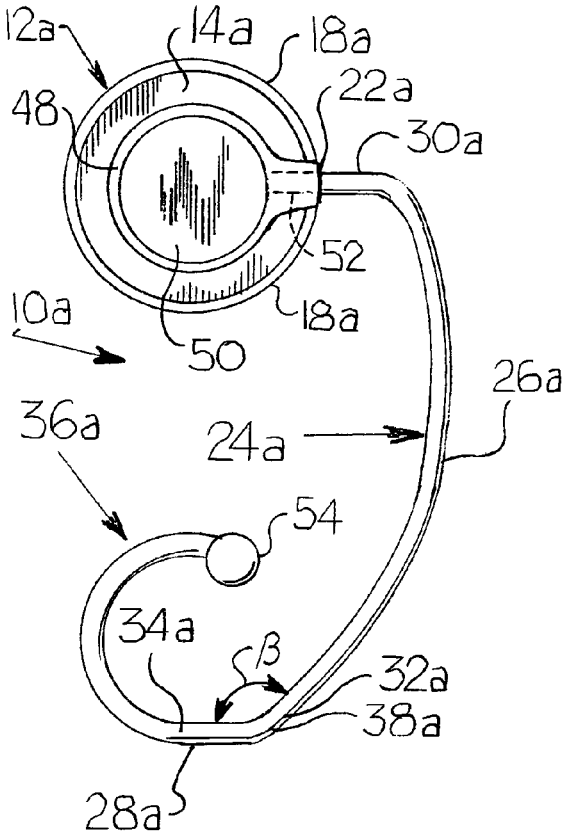
FIG. 10 is a top view of the holder shown in FIGS. 7-9 with the hanger in a storage position.
Figure 11:
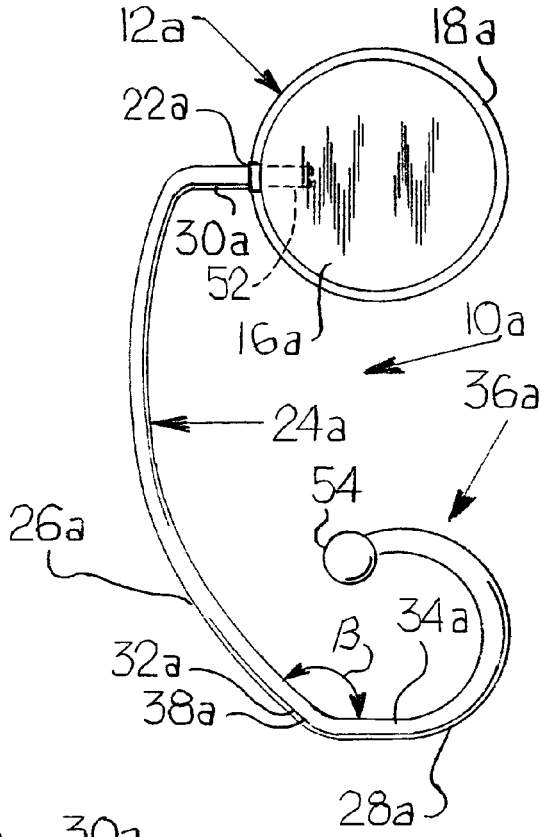
FIG. 11 is a bottom view of the holder shown in FIGS. 7-10.
Figure 12:
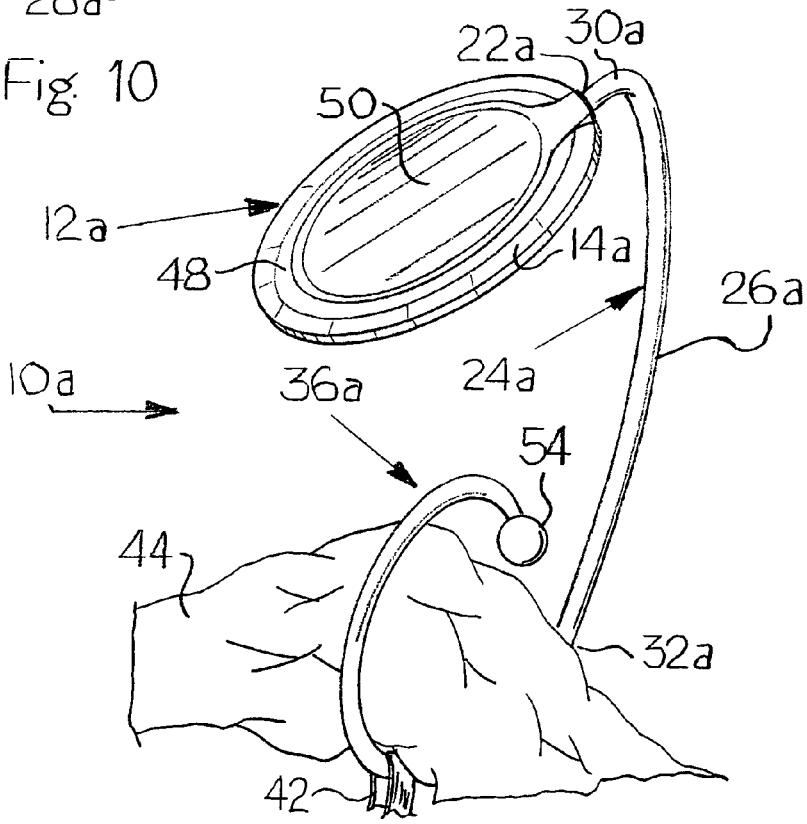
FIG. 12 is a perspective view of the holder shown in FIGS. 7-11.
Figure 13:
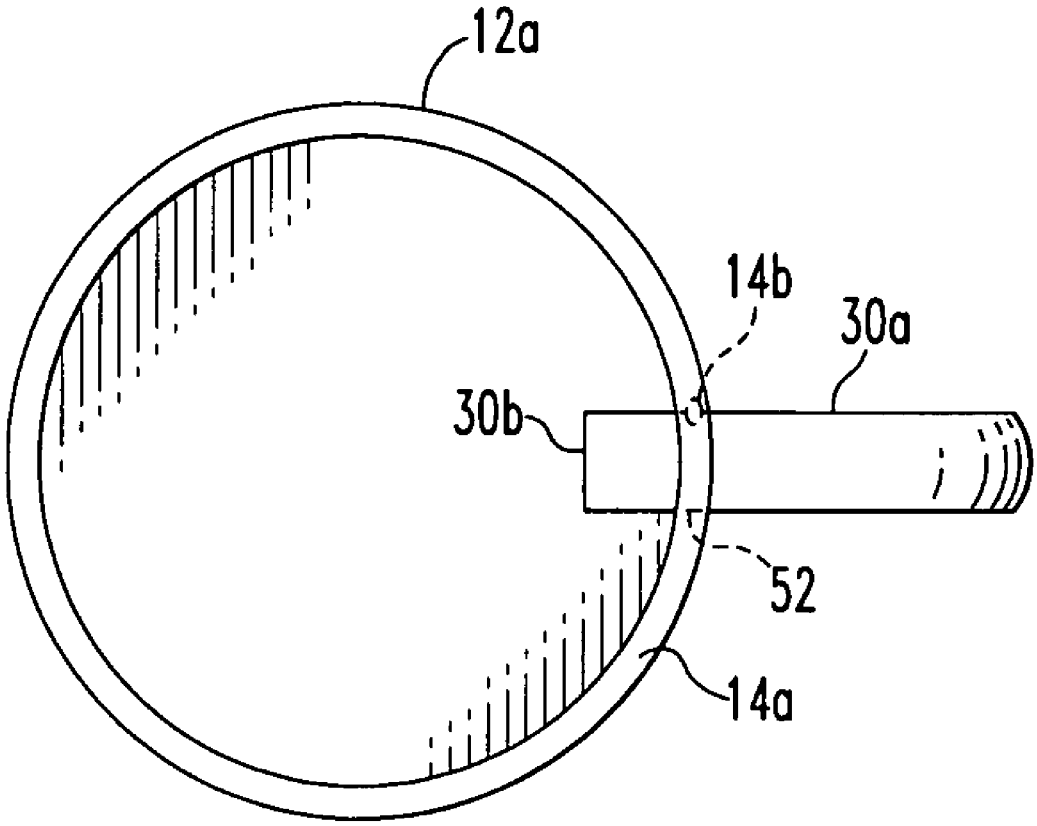

FIGS. 7-12 generally show a holder 10*a* according to a second embodiment of the present invention. As shown in FIG. 7 and the combination of FIGS. 8 and 9, the holder 10*a* according to the second embodiment of the present invention generally includes a base 12*a* having a first surface 14*a*, second surface 16*a*, and an outer edge 18*a*. The base 12*a* is preferably circular in shape when viewed from a top perspective or a bottom perspective and is preferably made from metal, such as brass or other suitable metal or metal alloy, plastic, or any other suitable material. As shown in FIGS. 9, 10, and 12, the first surface 14*a* defines a ridge 48 and a depression 50, with the depression configured to receive a pad, such as the pad 20 shown in FIGS. 1, 2, 5, and 6 of the first embodiment.

As shown in FIGS. 9-11, a hanger 24*a* is pivotally connected to the base 12*a* via a cavity or bore 52 defined by the base 12*a*. As clearly shown in FIG. 7, the base has a flat bottom that can be positioned on the horizontal surface 40 at the leading edge 46 of a table or counter. It is also clear from FIGS. 7-13 that the hanger pivots around a substantially horizontal axis when the bottom of the base is positioned on a flat horizontal surface because the axis of the pivot connection is then substantially horizontal and lies in a plane between the top and bottom surfaces of the base. Most preferably, the bore 52 extends between the first (top) and second (bottom) surfaces of the base 12*a* when resting flat on a table. The first end of the hook has a head 30*b* with a diameter larger than the first portion 3% of the hook and smaller than the bore 52. Once the head has been inserted in the bore 52, the first surface 14*a* or the bottom surface can be crimped 141 to narrow the bore slightly behind the head to prevent the first portion of the hook from being removed from the bore. The hanger 24*a* may be made of metal, metal alloy, plastic, or other suitable material and, as shown generally in FIGS. 7-12, may include a generally curve-shaped first pendent portion 26*a* integrally formed to a second portion 28*a*. The first pendent portion 26*a* has a first end 30*a* and a second end 32*a*, with the first end 30*a* of the first pendent portion 26*a* of the hanger 24*a* bent at an angle with respect to a balance of the first pendent portion 26*a* of the hanger 24*a*. The first end 30*a* of the first pendent portion 26*a* of the hanger 24*a* is inserted into the cavity 52 defined by the base 12*a* as to define a pivot joint 22*a*, so that the hanger 24*a* is rotatable with respect to the base 12*a*.

The second portion 28*a* of the hanger 24*a* generally includes a stem 34*a* that is connected to the second end 32*a* of the first pendent portion 26*a* of the hanger 24*a* and a C-shaped loop 36*a* connected to the stem 34*a*. The stem 34*a* intersects the second end 32*a* of the first pendent portion 26*a* of the hanger 24*a* at an intersection point 38*a* such that at an angle β is defined between the second end 32*a* of first pendent portion 26*a* of the hanger 24*a* and the stem 34*a*. As is clear from FIG. 7, the second portion of the hanger 24*a* has a C-shaped opening upward when the flat bottom of the base is resting on a horizontal surface and the stem 34*a* of the hanger 24*a* is pivoted to a more or less vertical position and the loop is shaped to locate an article held thereby directly below the bottom surface of the base. Most preferably, the center of the loop is exactly under the center of the base so that gravity acts as the anchor for the base. The weight of the held item becomes the anchor for the base. Once an item is placed on the hook, the base does not move off a flat surface. The C-shaped loop 36*a* is preferably large enough to allow a scarf 44, gloves, or other clothing article to easily pass through the C-shaped loop 36*a* without being bunched or clamped. A stop 54 may be added to a free end of the C-shaped loop 36*a* to prevent a sharp edge and help hold articles.

FIGS. 10 and 11 show the holder 10*a* according to a second embodiment of the present invention in two respective storage positions. In operation, as shown in FIG. 7, the second surface 16*a* of the base 12*a* is placed on a table or other generally planar surface 40 adjacent to a leading overhung edge 46. The hanger 24*a* is pivoted with respect to the base 12*a* via the pivot joint 22*a* so that the hanger 24*a* extends away from the base 12*a* and the planar surface 40 and is substantially parallel to the leading overhung edge 46. As shown in FIG. 12, a handbag carrying strap 42 may be placed on the stem 34*a* of the second portion 28*a* of the hanger 24*a* adjacent to the intersection point 38*a* of the first pendent portion 26*a* of the hanger 24*a* and the stem 34*a*. A scarf 44 or other clothing article can also be fed through the C-shaped loop 36*a*.

When the articles do not need to be held any longer, the scarf 44 can be removed from the C-shaped loop 36*a* and the handbag carrying strap 42 can be removed from the stem 34*a*. As shown in FIGS. 10 and 11, the base 12*a* can then be removed from the planar surface 40 (FIG. 7), and the hanger 24*a* can be moved into a storage position by pivoting the hanger 24*a* to lie in the same imaginary plane as the base 12*a*.

As described above, a holder 10, 10*a* according to either embodiment of the present invention offers the advantages of a simple design, is easy to manufacture, is multi-functional, and can hold or support a clothing article without compressing the clothing article.

The protective pad 20 is preferably a resilient polymer that enables the base to grip onto flat, slippery surfaces, such as glass, wood, polyurethane, metal, or linen without sliding off but without leaving a mark on the surface. A particularly suitable protective pad is a 70 Shore A durometer clear urethane 0.02 to 0.05, say 0.031, thick with an acrylic pressure-sensitive adhesive on one side. It is believed that a Shore A durometer hardness of 60 to 80 is acceptable. The adhesive side is placed against the second surface 16, 16*a* and secured the pad to the base 12, 12*a*.

Figure 8:
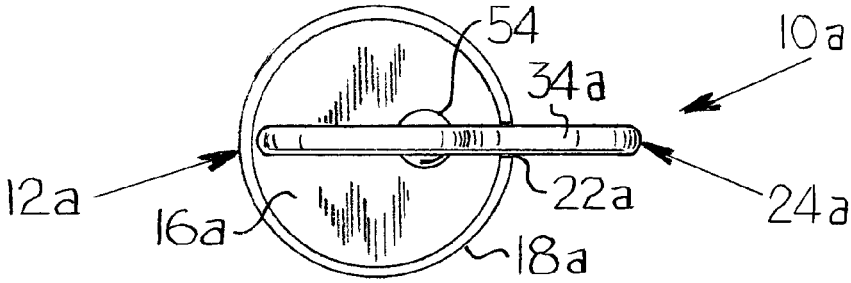
FIG. 8 is a bottom view of the holder shown in FIG. 7.

Referring to FIG. 8, the depression 50 in the first surface 14*a* supports a decorative natural or synthetic gemstone 51. In a sense, when in use, the holder becomes a piece of table jewelry.

As shown in FIGS. 7 to 12, the loop 36*a* when the first pendent portion is hanging down forms a C shape open toward the first pendent portion as opposed to a J-shaped opening upwardly. This enables the user to place multiple objects on the hook as opposed to a hook with a shallow J-shaped hook.

The invention has been described with reference to the preferred embodiments. Obvious modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A holder for an article comprising:

a base having a flat bottom for resting on a horizontal surface at the edge of a table or counter and an upper surface; and a hanger having a first portion and a second portion, the first portion having a first end and a second end, and the second portion defining a loop, wherein the first end of the first portion of the hanger is pivotally connected to the base to rotate only about a generally horizontal axis when the flat bottom is resting on the horizontal surface, said generally horizontal axis lying in a plane between the flat bottom and the upper surface of the base, there being a bore between the flat bottom and the upper surface and said first portion of the hanger being inserted into said bore and said first portion of the hanger having a head slightly smaller than the bore and slightly larger than the first portion of the hanger and the base being crimped behind the head to prevent the removal of the first portion from the base, the loop having an opening, when the flat bottom of the base is resting on the horizontal surface and the second portion of the hanger is pivoted to a more or less vertical position, being positionable directly below the horizontal surface, and the loop supports the article but does not compress the article.

2. The holder as claimed in claim 1, further comprising a pad positioned adjacent to the base.

3. The holder according to claim 1, further comprising a resilient pad.

4. The holder according to claim 1, further comprising a urethane pad approximately 0.02 to 0.05 inches thick having a Shore A durometer hardness of 60 to 80.

5. The holder as claimed in claim 1, wherein the first flat bottom of the base and the second upper surface of the base each define a circular shape.

6. The holder as claimed in claim 1, wherein a synthetic or real gemstone is mounted over the second upper surface of the base.

7. The holder as claimed in claim 1, wherein the loop is a substantially closed O-shaped loop.

8. The holder as claimed in claim 1, wherein the loop is a C-shaped loop.

9. The holder according to claim 8, wherein the C-shaped loop opens toward the first portion of the hanger.

10. The holder as claimed in claim 8, further comprising a ball positioned at a free end of the C-shaped loop.

11. The holder as claimed in claim 1, wherein the base is made from metal.

12. A holder for an article comprising:

a base having a first flat bottom for resting on a horizontal surface at the edge of a table or counter and a second upper surface;

a hanger having a first portion and a second portion, the first portion having a first end and a second end, and the second portion defining a loop, wherein the first end of the first portion of the hanger is pivotally connected to the base to rotate only about a generally horizontal axis when the first flat bottom is resting on a horizontal surface, said generally horizontal axis lying in a plane between the first flat bottom and the second upper surfaces of the base, the loop having an opening, when the first flat bottom of the base is resting on a horizontal surface and the second portion of the hanger is pivoted to a more or less vertical position, being positionable directly below the horizontal surface, and the loop supports the article but does not compress the article, further comprising a bore between the first flat bottom and the second upper surface and said first portion of the hanger being inserted into said bore, wherein the first portion of the hanger has a head slightly smaller than the bore and slightly larger than the first portion of the hanger and the base is crimped behind the head to prevent the removal of the first portion from the base, and further comprising a resilient pad.

* * * * *